US008276665B2

(12) United States Patent
Webb et al.

(10) Patent No.: US 8,276,665 B2
(45) Date of Patent: Oct. 2, 2012

(54) PLUG RELEASE APPARATUS

(75) Inventors: Earl Webb, Duncan, OK (US); Henry Rogers, Duncan, OK (US); Steve Holden, Fletcher, OK (US); Steve Streich, Duncan, OK (US); Brock Watson, Carrollton, TX (US)

(73) Assignee: Halliburton Energy Services Inc., Duncan, OH (US)

( * ) Notice: Subject to any disclaimer, the term of this patent is extended or adjusted under 35 U.S.C. 154(b) by 365 days.

(21) Appl. No.: 12/061,701

(22) Filed: Apr. 3, 2008

(65) Prior Publication Data

US 2009/0250217 A1 Oct. 8, 2009

(51) Int. Cl.
*E21B 33/00* (2006.01)

(52) U.S. Cl. .... 166/285; 166/181; 166/386; 166/250.04

(58) Field of Classification Search ..... 166/250.04, 166/285, 181, 386
See application file for complete search history.

(56) References Cited

U.S. PATENT DOCUMENTS

| | | | | | |
|---|---|---|---|---|---|
| 3,070,169 | A | * | 12/1962 | Spain et al. | 166/177.3 |
| 3,796,260 | A | | 3/1974 | Bradley | 166/153 |
| 3,915,226 | A | | 10/1975 | Savage | 166/153 |
| 4,364,432 | A | | 12/1982 | Bass et al. | 166/290 |
| 4,545,434 | A | | 10/1985 | Higgins | 166/217 |
| 4,624,312 | A | | 11/1986 | McMullin | 166/155 |
| 4,671,358 | A | | 6/1987 | Lindsey, Jr. et al. | 166/291 |
| 4,809,776 | A | | 3/1989 | Bradley | 166/153 |
| 5,038,862 | A | | 8/1991 | Giroux et al. | 166/289 |
| 5,040,602 | A | | 8/1991 | Helms | 166/285 |
| 5,095,988 | A | | 3/1992 | Bode | 166/291 |
| 5,117,910 | A | | 6/1992 | Brandell et al. | |
| 5,178,216 | A | | 1/1993 | Giroux et al. | 166/242 |
| 5,314,015 | A | | 5/1994 | Streich et al. | 166/184 |
| 5,392,852 | A | | 2/1995 | Laurel et al. | 166/153 |
| 5,413,172 | A | | 5/1995 | Laurel | 166/153 |
| 5,443,122 | A | | 8/1995 | Brisco | 166/285 |
| 5,718,287 | A | | 2/1998 | Streich et al. | 166/66.6 |
| 5,722,491 | A | | 3/1998 | Sullaway et al. | 166/291 |
| 5,762,139 | A | * | 6/1998 | Sullaway et al. | 166/291 |
| 5,787,979 | A | | 8/1998 | Giroux et al. | 166/177.4 |
| 5,829,523 | A | | 11/1998 | North | 166/250.14 |
| 6,082,451 | A | | 7/2000 | Giroux et al. | 166/72 |
| 6,318,472 | B1 | * | 11/2001 | Rogers et al. | 166/382 |
| 6,571,869 | B1 | | 6/2003 | Pluchek et al. | 166/177.4 |
| 6,571,880 | B1 | | 6/2003 | Butterfield, Jr. et al. | |

(Continued)

OTHER PUBLICATIONS

Printout from Smith Services website: http://www.siismithservices.com/b_products/product_page.asp?ID=117, dated Apr. 2, 2008.

(Continued)

*Primary Examiner* — Kenneth L Thompson
*Assistant Examiner* — Yong-Suk Ro
(74) *Attorney, Agent, or Firm* — John W. Wustenberg; McDermott, Will & Emery LLP

(57) ABSTRACT

A plug release apparatus for use in a well bore, the apparatus having a canister, a liner plug, and a sub. The liner plug may be releasably attached to the canister via a first release mechanism. The sub may be releasably attached to the canister via a second release mechanism. The first release mechanism may be configured to release the liner plug from the canister at a first pressure and the second release mechanism may be configured to release the canister from the sub at a second pressure.

25 Claims, 6 Drawing Sheets

U.S. PATENT DOCUMENTS

| | | | | |
|---|---|---|---|---|
| 6,799,638 | B2 | 10/2004 | Butterfield, Jr. | 166/386 |
| 7,182,135 | B2 * | 2/2007 | Szarka | 166/265 |
| 2006/0237186 | A1 | 10/2006 | Mondelli et al. | |

OTHER PUBLICATIONS

Printout from Smith Services website: http://www.siismithservices.com/b_products/product_page.asp?ID=115, dated Apr. 2, 2008.

Smith Services Brochure "Dual Liner Wiper Plug System," date unknown.

TIW Brochure "Pump-Down and Liner-Wiper Plugs," date unknown.

Printout from Allamon Tool website: http://www.allamontool.com/mnuSingleWiperPlugSWP.htm, dated Apr. 2, 2008.

Printout from Allamon Tool website: http://www.allamontool.com/mnuEZDLinerWiperPlug.htm, dated Apr. 2, 2008.

International Search Report and Written Opinion for PCT/GB2009/000766.

International Preliminary Report on Patentability for PCT/GB2009/000766, dated Oct. 14, 2010.

* cited by examiner

PLUG RELEASE APPARATUS

BACKGROUND

This invention relates to a plug release apparatus used in the introduction and separation of fluids in a well, such as the introduction and separation of cement slurry and displacing fluid in an oil or gas well.

Cement is used in oil or gas wells for various purposes. One purpose is to secure a tubular string (e.g., a casing or a liner) in the well bore. This is typically done by pumping cement down the tubular string and forcing it back up an annular space between the outside of the string and the well bore or a larger diameter string in which the first-mentioned string is disposed. To separate the cement slurry from drilling mud typically in the well when the cementing operation begins, a bottom cementing plug is placed in line and pumped down the string by the force of the following cement slurry. This bottom plug serves to minimize contamination of the cement as it is being pumped down the tubular string. It also wipes any accumulated mud film from the inner diameter of the string and pushes it ahead. To separate a following displacing fluid used to push the cement slurry out the tubular string and up the annular space, a top cementing plug is placed in line and pushed down the string by the displacing fluid. This top plug follows the cement and wipes any accumulated cement film from the inner diameter of the tubular string. It also prevents or reduces any contamination of the cement by the displacing fluid.

In wells drilled on land, surface-mounted plug release apparatus are used in many cementing jobs to release the cementing plugs at the proper time. Normal job operations will have the bottom cementing plug loaded into the plug release apparatus prior to pumping cement. The top cementing plug will typically be loaded after the bottom plug is released Subsea (ocean floor) completions are different from the aforementioned land-based cementing operations in that the cementing plugs used for separating the fluids are preferably located in the tubular string below the ocean floor. This is preferred because these plugs have a diameter large enough to wipe the inner diameter of the tubular string extending below the ocean floor, and this tubular string (and thus each plug) typically has a larger diameter than need be used for connecting this string with the equipment on the rig at the ocean's surface. Thus, the cement slurry is preferably pumped from the surface through a string of drill pipe smaller than the string being cemented, which smaller string extends between the surface rig and the downhole string to be cemented. Thus, there is a second type of plug container that houses elements, which may broadly be called "plugs" also, which are of smaller diameter to permit these plugs to pass through the narrower connecting string and into the downhole cementing plugs. A system using this technique is the Halliburton Energy Services' sub-surface release system ("SSR Cementing Plug Method"). This system provides a means of wiping different pipe sizes; therefore, smaller diameter drill pipe can be used as described instead of the larger diameter casing that otherwise would be run between the rig floor and the ocean floor.

Many offshore casing jobs run pipe from down-hole all the way up to the wellhead on the ocean floor. To do this, the casing is attached to drill pipe and lowered into position from the ocean surface. Liner jobs are extremely similar to the offshore casing job in that they use drill pipe to lower the liner into position except that the top of the pipe is not located at the well head on the ocean floor. Instead, the top of the pipe is located somewhere inside another casing string below the ocean floor or below the surface on a land-based job. The plug set used on an offshore casing job is referred to as an SSR. The liner plug set has a similar configuration and can be run offshore or on land.

These drill pipe operated SSR or liner cementing plugs sometimes do not operate as designed. In some instances, this can (1) prevent cement from being displaced from the liner or casing, (2) cause the hanger to prematurely set, and/or (3) cause rupture disks on tools above to deploy prematurely. This results in a well bore full of cement or over displaced cement. To remedy this, drill out, drill around, bull heading, or retrieval of the liner may be needed, all of which are very costly. While the exact cause of the problem is not known, some possibilities include the following: debris interfering with the releasing mechanism in the plug releasing mechanism; obstacles such as shoulders in the drill pipe or tools that positively stop the latch-down plug; or hydraulic lock between the latch-down plug body and the releasing mechanism.

SUMMARY

This invention relates to a plug release apparatus used in the introduction and separation of fluids in a well, such as the introduction and separation of cement slurry and displacing fluid in an oil or gas well.

In one embodiment, a plug release apparatus for use in a well bore comprises a canister, a liner plug releasably attached to the canister via a first release mechanism, and a sub releasably attached to the canister via a second release mechanism. The first release mechanism of this embodiment is configured to release the liner plug from the canister at a first pressure, and the second release mechanism of this embodiment is configured to release the canister from the sub at a second pressure.

In one embodiment, a plug system for use in a well bore comprises a plug release apparatus, a latch-down plug, and a landing collar. The plug release apparatus of this embodiment comprises a canister, a liner plug releasably attached to the canister via a first release mechanism, and a sub releasably attached to the canister via a second release mechanism. The first release mechanism of this embodiment is configured to release the liner plug from the canister at a first pressure, and the second release mechanism of this embodiment is configured to release the canister from the sub at a second pressure.

The features and advantages of the present invention will be readily apparent to those skilled in the art. While numerous changes may be made by those skilled in the art, such changes are within the spirit of the invention.

BRIEF DESCRIPTION OF THE DRAWINGS

These drawings illustrate certain aspects of some of the embodiments of the present invention, and should not be used to limit or define the invention.

DESCRIPTION OF PREFERRED EMBODIMENTS

This invention relates to a plug release apparatus used in the introduction and separation of fluids in a well, such as the introduction and separation of cement slurry and displacing fluid in an oil or gas well.

Figure 1:
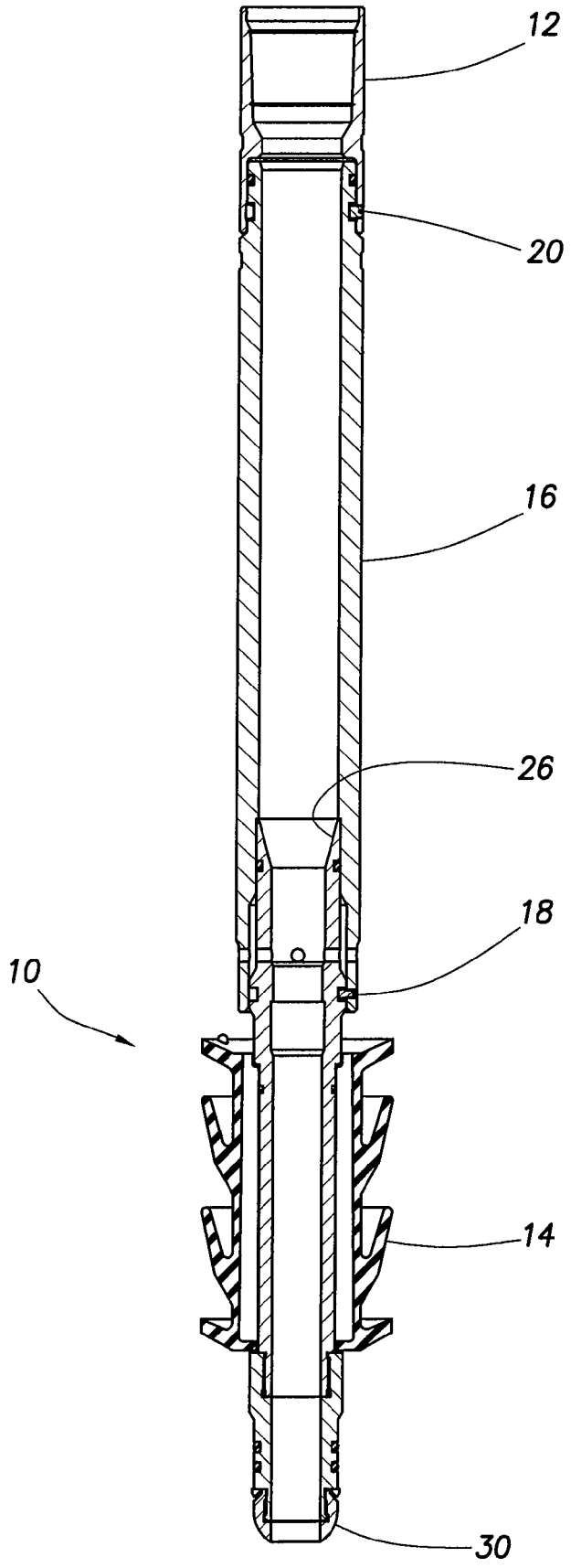
FIG. 1 is a side view of a plug release apparatus in accordance with one embodiment of the present invention.
Figure 2:
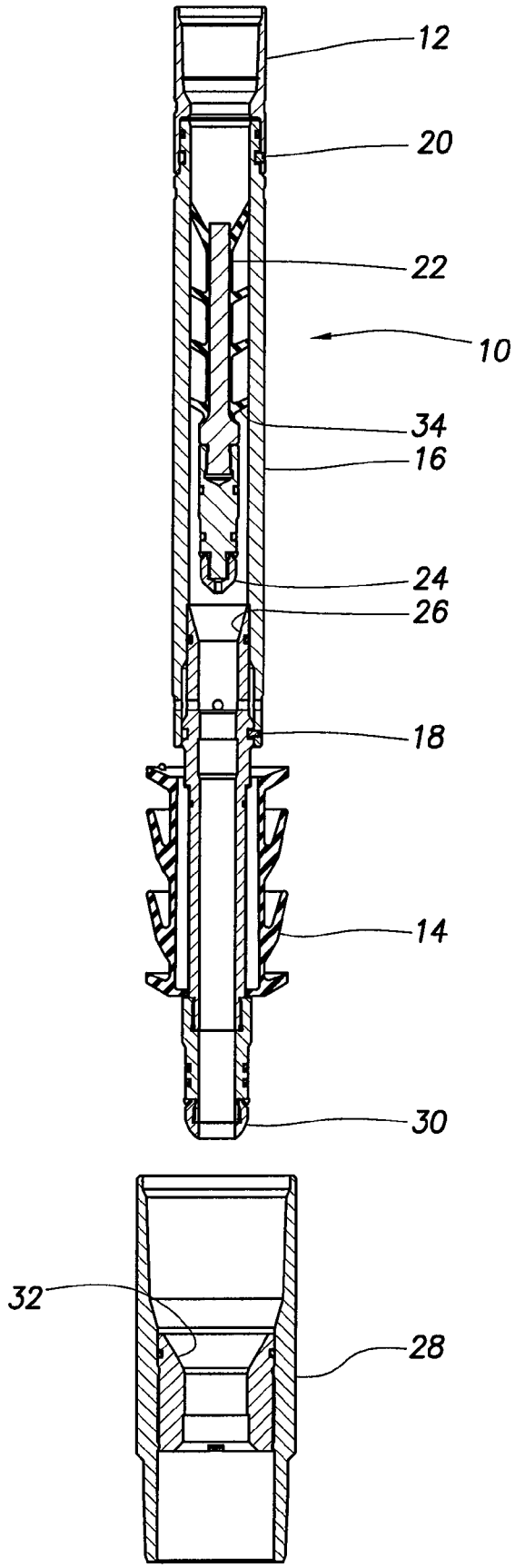
FIG. 2 is a side view of the plug release apparatus of FIG. 1, showing a latch-down plug therein.

Referring now to the drawings, and more particularly to FIGS. 1 and 2, plug release apparatus 10 is releasably attached to a lower end of a circulation tool, a running tool, or the like (not shown) via sub 12 or any other connection suitable for uniting plug release apparatus 10 and a work string. Liner plug 14 is releasably connected to canister 16. In one embodiment, shear pins are used to provide release mechanism 18 between liner plug 14 and canister 16 and to provide release mechanism 20 between canister 16 and sub 12.

Figure 3:
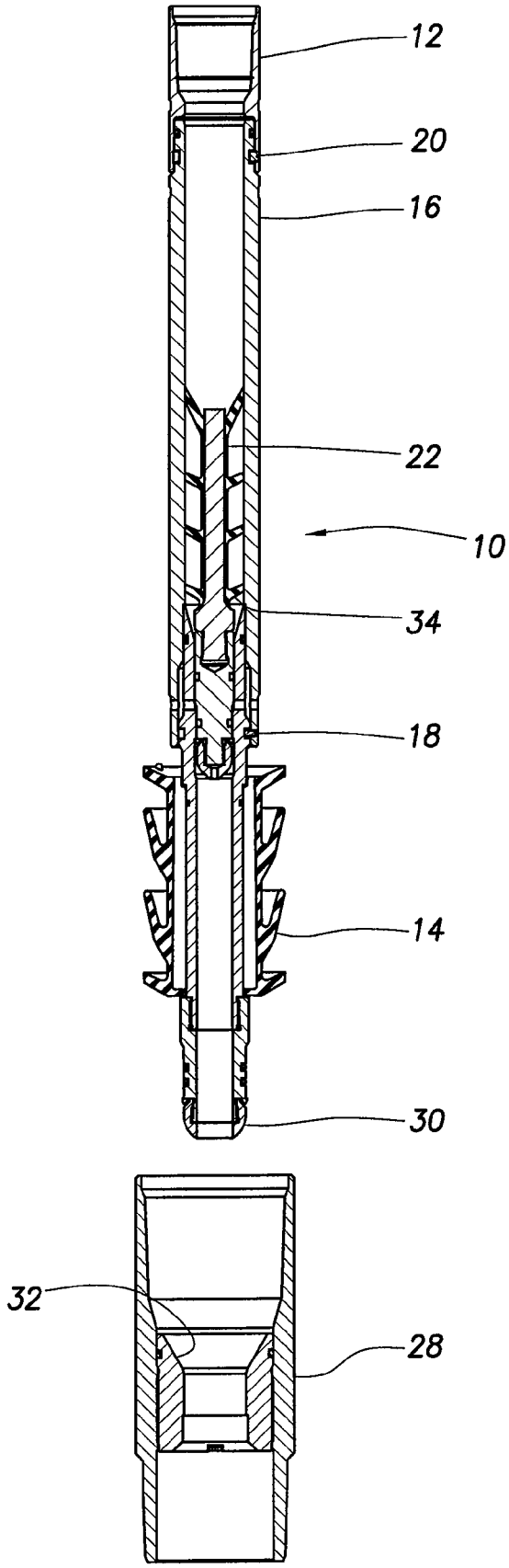
FIG. 3 is a side view of the plug release apparatus of FIGS. 1 and 2, showing the latch-down plug in another position therein.

Referring now to FIG. 2, latch-down plug 22 may pass through work string, past sub 12 and into canister 16. Nose portion 24 of latch-down plug 22 may land on shoulder 26 formed in liner plug 14, as indicated in FIG. 3. More specifically, nose portion 24 may land on shoulder 26 with a matching profile. Pressure may then be applied until one of release mechanisms 18 or 20 releases, allowing liner plug 14 and latch-down plug 22 to move downward into engagement with landing collar 28. In particular, nose portion 30 of liner plug 14 may engage a matching profile shoulder 32 of landing collar 28. Shoulder 32 may be tapered to create a self-cleaning effect.

Figure 4:
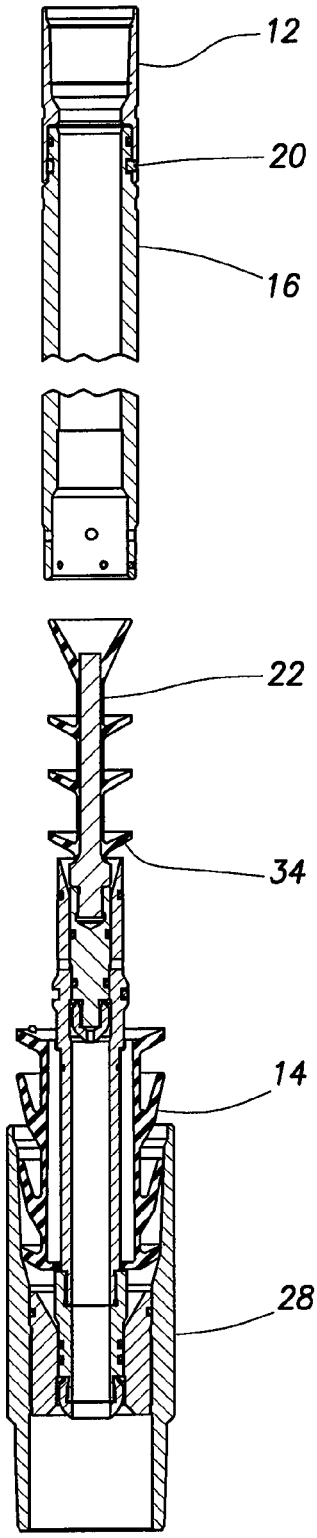
FIG. 4 is a side view of the plug release apparatus of FIGS. 1-3, after release of a release mechanism.

It may be desirable to retrieve canister 16 for reuse. Generally, this may be achieved by selecting a lower pressure trigger point for release mechanism 18 than for release mechanism 20. In this embodiment, release mechanism 18 may be considered a "primary" release mechanism and release mechanism 20 may be considered a "secondary" or "backup" release mechanism. As shown in FIG. 4, when release mechanism 18 between liner plug 14 and canister 16 has a lower pressure trigger point than release mechanism 20 between canister 16 and sub 12, canister 16 will separate from liner plug 14 without triggering release mechanism 20 between canister 16 and sub 12. Thus, canister 16 may subsequently be brought to the surface and later reused.

While it is generally desirable to retrieve canister 16, various conditions may prevent release mechanism 18 between canister 16 and liner plug 14 from releasing. For example, this may happen when debris interferes with release mechanism 18, or when hydraulic lock occurs between latch-down plug 22 and release mechanism 18. In the event release mechanism 18 between canister 16 and liner plug 14 does not release at the desired pressure, additional pressure may be applied until the trigger pressure of release mechanism 20 between canister 16 and sub 12 is reached. The amount of additional pressure necessary to trigger release mechanism 20 may vary, depending on the particular circumstances. In some instances, release mechanism 20 may be configured to release at the same pressure as release mechanism 18, or possibly at a lower pressure, thus reversing the "primary" and "secondary" release mechanisms. In the various configurations, liner plug 14 may either release from sub 12 by release mechanism 18 or by release mechanism 20, thus reducing or eliminating the likelihood of experiencing many of the drawbacks associated with excessive pressure. For example, in conventional devices, when the liner plug does not release from the sub, cement cannot be displaced from the liner or casing, the hanger can prematurely set, and/or rupture disks on tools above may be deployed prematurely. This results in hard cement insider the liner and a lack of cement around the outside, which requires drill out, drill around, bull heading, retrieval of the liner, or abandonment of the well bore.

Figure 5:
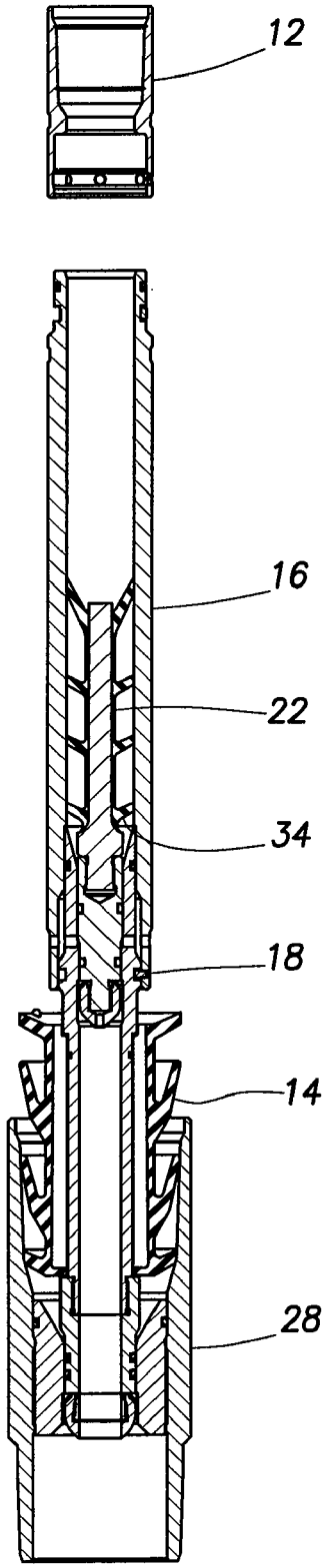
FIG. 5 is a side view of the plug release apparatus of FIGS. 1-3, after release of an alternate release mechanism.

As indicated in FIG. 5, when release mechanism 20 is triggered, canister 16 may travel downhole with liner plug 14. Thus, it may be desirable for canister 16 to be constructed of drillable materials such as aluminum, cast iron, brass, or composites.

Figure 6:
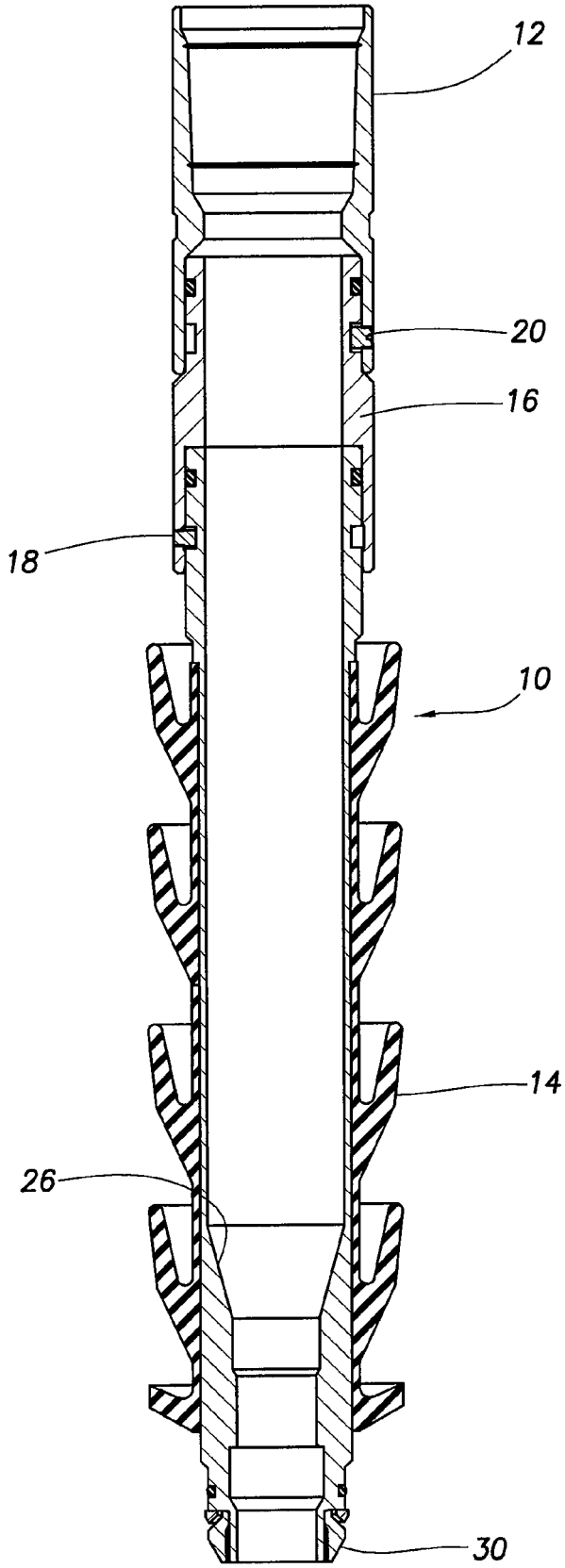
FIG. 6 is a plug release apparatus in accordance with another embodiment of the present invention.

Referring now to FIG. 6, an alternate embodiment shows shoulder 26 in a lower portion of liner plug 14 relative to the position of shoulder 26 illustrated in FIGS. 1-5. This modified position of shoulder 26 allows canister 16 to be shorter, as latch-down plug 22 may be "swallowed" in liner plug 14.

In one exemplary embodiment, canister 16 is tubular and constructed of aluminum, release mechanism 18 has 1,350 psi shear pins, and release mechanism 20 has 3,500 psi shear pins. Alternatively, release mechanism 20 may have shear pins that cause release mechanism 20 to trigger at 4,500 psi or 5,000 psi. One of skill in the art will appreciate that the release pressure of shear pins for release mechanisms 18 and 20 may vary to suit the particular conditions and desired application. Further, release mechanisms 18 and/or 20 are not limited to shear pins, so long as they are releasable. For example, release mechanisms 18 and 20 may be a collet system, a tension sleeve, or any of a number of other devices.

It is believed that latch-down plug 22 may push debris in front of first wiper 34. This debris may pack off when it reaches shoulder 26. Should this happen, release mechanism 20, located above latch-down plug 22 and debris will experience the same release pressure intended for release mechanism 18. As the pressure rises to a predetermined point above the trigger pressure for release mechanism 18, release mechanism 20, which is not encumbered by debris, will release liner plug 14, release mechanism 18, and debris downhole.

Some believe that a hydraulic lock may be occurring between first wiper 34 and releasing mechanism 18, preventing full pressure from being applied to release mechanism 18. If this happens, release mechanism 20 will function in the same manner as it does for the debris pack off between latch-down plug 22 and release mechanism 18.

Another situation that has been seen in liner hanger jobs is rupture of an elastomeric equalizer mechanism located above liner plug 14. The apparatus of the present invention may eliminate the need for the whole equalizer mechanism by placing a bypass (a set of holes) located immediately above release mechanism 18. When liner plug 14 seats in shoulder 26, o-rings seal both above and below the bypass hole. The closing of the bypass in necessary so that the top of liner plug 14 will be sealed when it lands on landing collar 28 as is normal to apply pressure to liner plug 14 after it lands on landing collar 28.

Other features of the invention may reduce the cost or improve the reliability of the system and include the following: replacement of a swivel with shear pins that rotate in grooves; and latch down, seal profile between liner plug 14 and landing collar 28. Replacing the swivel with shear pins may allow liner plug 14 to rotate, thus eliminating the need for a swivel above plug release apparatus 10. A free fitting mandrel mounted liner plug 14 would also allow rotation during installation procedures, improving the ability to assembly liner plugs 14 without adversely affecting release mechanism 18.

Further, a contingency release system (i.e. canister 16, completely housing latch-down plug 22, coupled with release mechanism 20 above an upper end of liner plug 14 helps to ensure releasing of liner plug 14. Improved reliability in the launch system helps to ensure problem jobs do not occur with the undesired result of liner plug 14 being filled with cement. Thus, release mechanism 20 addresses the lacking reliability of conventional liner plug release mechanisms.

This may also eliminate the need for a seal interface between a bottom of liner plug 14 and landing collar 28. The load may be transferred through latch-down plug 22 and landing collar 28.

The teachings of this disclosure may provide for positive shutoff via a latch down load carrying system. However, while a liner plug system is used to illustrate the invention, it would be suitable for various sub-surface launch set applications, including but not limited to cementing plugs and liner hanger operations.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Moreover, the indefinite articles "a" or "an," as used in the claims, are defined herein to mean one or more than one of the element that it introduces. Also, the terms in the claims have their plain, ordinary meaning unless otherwise explicitly and clearly defined by the patentee.

What is claimed is:

1. A plug release apparatus for use in a well bore, comprising:

a canister;

a liner plug releasably attached to the canister via a first release mechanism; and, a sub releasably attached to the canister via a second release mechanism;

wherein the first release mechanism is configured to release the liner plug from the canister at a first pressure;

wherein the second release mechanism is configured to release the canister from the sub at a second pressure;

wherein the second release mechanism releases the canister from the sub in the event that the first mechanism fails to release the liner plug; and, wherein the canister is configured to be reused.

2. The plug release apparatus of claim 1, wherein the first pressure is equal to the second pressure.

3. The plug release apparatus of claim 1, wherein the first pressure is lower than the second pressure.

4. The plug release apparatus of claim 1, wherein the canister is constructed of a drillable material.

5. The plug release apparatus of claim 1, wherein the first release mechanism comprises at least one shear pin.

6. The plug release apparatus of claim 5, wherein the second release mechanism comprises at least one shear pin.

7. The plug release apparatus of claim 1, wherein the second release mechanism comprises at least one shear pin.

8. The plug release apparatus of claim 1, wherein the liner plug has a nose portion configured to engage a shoulder in a landing collar.

9. The plug release apparatus of claim 1, wherein the liner plug comprises a shoulder configured to engage a nose portion of a latch-down plug.

10. The plug release apparatus of claim 9, wherein the shoulder is in an upper portion of the liner plug.

11. The plug release apparatus of claim 9, wherein the shoulder is in a lower portion of the liner plug, such that the liner plug is configured to swallow the latch-down plug.

12. The plug release apparatus of claim 9, wherein the plug release apparatus is further configured to allow the liner plug to rotate.

13. The plug release apparatus of claim 1, wherein the liner plug is configured to receive a latch down plug; and wherein the sub and canister are configured to allow passage of the latch down plug through the sub and past the second release mechanism.

14. A plug system for use in a well bore, comprising:

a plug release apparatus comprising a canister, a liner plug releasably attached to the canister via a first release mechanism, and a sub releasably attached to the canister via a second release mechanism, wherein the first release mechanism is configured to release the liner plug from the canister at a first pressure, wherein the second release mechanism is configured to release the canister from the sub at a second pressure, wherein the second release mechanism releases the canister from the sub in the event that the first mechanism fails to release the liner plug; and, wherein the canister is configured to be reused;

a latch-down plug; and a landing collar.

15. The plug system of claim 14, wherein the first pressure is equal to or lower than the second pressure.

16. The plug system of claim 14, wherein the canister is constructed of a drillable material.

17. The plug system of claim 14, wherein the first release mechanism comprises at least one shear pin.

18. The plug system of claim 14, wherein the second release mechanism comprises at least one shear pin.

19. The plug system of claim 14, wherein the liner plug has a nose portion configured to engage a shoulder in the landing collar.

20. The plug system of claim 14, wherein the liner plug comprises a shoulder configured to engage a nose portion of the latch-down plug.

21. The plug system of claim 20, wherein the shoulder is in an upper portion of the liner plug.

22. The plug system of claim 20, wherein the shoulder is in a lower portion of the liner plug, such that the liner plug is configured to swallow the latch-down plug.

23. The plug release system of claim 14, wherein the plug release apparatus is further configured to allow the liner plug to rotate.

24. A method for activating a plug release apparatus comprising:

providing the plug release apparatus comprising:

a canister configured to be reused;

a liner plug releasably attached to the canister via a first release mechanism; and a sub releasably attached to the canister via a second release mechanism;

applying a pressure sufficient to trigger at least one of the release mechanisms to release; and wherein the second release mechanism releases the canister from the sub in the event that the first mechanism fails to release the liner plug; and, determining whether any of the release mechanisms are triggered.

25. The method for activating a plug release apparatus of claim 24, further comprising applying a second pressure sufficient to trigger another of the release mechanisms to release.

* * * * *